United States Patent [19]

Neuhäuser et al.

[11] 4,435,226

[45] Mar. 6, 1984

[54] WEAR RESISTANT CAST IRON ALLOY WITH SPHEROIDAL GRAPHITE SEPARATION AND MANUFACTURING METHOD THEREFOR

[75] Inventors: Hans J. Neuhäuser, Bergish-Gladbach; Hans-Jürgen Veutgen, Burscheid, both of Fed. Rep. of Germany

[73] Assignee: Goetze AG, Burscheid, Fed. Rep. of Germany

[21] Appl. No.: 444,962

[22] Filed: Nov. 29, 1982

[30] Foreign Application Priority Data

Dec. 1, 1981 [DE] Fed. Rep. of Germany ..... 3147461

[51] Int. Cl.[3] ..... C21D 5/06; C21D 5/14

[52] U.S. Cl. ..... 148/3; 148/35; 148/139

[58] Field of Search ..... 75/123 CB, 126 Q, 126 A, 75/128 C, 128 D; 148/35, 139, 3, 138

[56] References Cited

U.S. PATENT DOCUMENTS

| | | | |
|---|---|---|---|
| 2,970,902 | 2/1961 | Alexander et al. | 75/123 CB |
| 3,600,159 | 8/1971 | Moore et al. | 75/123 CB |
| 3,673,004 | 6/1972 | Dumitrescu | 75/123 CB |
| 4,153,477 | 5/1979 | Beyer et al. | 148/1 |

FOREIGN PATENT DOCUMENTS

| | | | |
|---|---|---|---|
| 1172049 | 6/1964 | Fed. Rep. of Germany . | |
| 2428821 | 12/1975 | Fed. Rep. of Germany | 75/123 CB |
| 50-14213 | 5/1975 | Japan | 75/128 D |
| 53-19916 | 2/1978 | Japan | 75/123 CB |
| 1482724 | 8/1977 | United Kingdom . | |
| 1500766 | 2/1978 | United Kingdom . | |
| 753923 | 8/1980 | U.S.S.R. | 148/139 |

*Primary Examiner*—Peter K. Skiff

*Attorney, Agent, or Firm*—Spencer & Frank

[57] ABSTRACT

A wear resistant cast iron alloy having a great strength for the manufacture of wear resistant machine parts having a tempered structure with embedded graphite spheroids formed in very fine form by the decomposition of ledeburite. The alloy has a spheroid number of 300,000 to 900,000/cm$^2$ and is comprised of 1.5 to 3.0% carbon, 3.0 to 6.0% silicon, 0.1 to 2.0% manganese, 0.05 to 0.5% phosphorus, up to a maximum of 0.15% sulfur, 0.1 to 1.0% chromium, 0 to 3.5% vanadium, 0.1 to 2.5% molybdenum, 0.1 to 3.0% nickel and/or cobalt, 0.1 to 3.5% copper, 0.1 to 2.5% tungsten, 0.1 to 1.0% titanium, niobium and/or tantalum, up to a maximum of 0.15% magnesium, and up to a maximum of 0.15% nitrogen. A method is provided for producing a cast piece of the cast iron alloy.

19 Claims, 2 Drawing Figures

WEAR RESISTANT CAST IRON ALLOY WITH SPHEROIDAL GRAPHITE SEPARATION AND MANUFACTURING METHOD THEREFOR

BACKGROUND OF THE INVENTION

The present invention relates to a wear resistant cast iron alloy of high strength and containing spheroidal graphite precipitates for the manufacture of machine parts that are subject to wear, such as piston rings of internal-combustion engines, and specifically small piston rings having a small radial and/or axial wall thickness, and to a method for manufacturing them.

Cast iron alloys for the manufacture of mechanically highly stressed machine parts, such as piston rings of internal-combustion engines, are special alloys, which, in addition to good running and wear characteristics and good elastic behavior, should also have great strength characteristics. In particular, small piston rings having small diameters of, for example, up to 6 mm, have a low absolute strength due to their small axial wall thickness of usually only 1 to 2 mm. Such rings frequently break, even if they are made of cast iron alloys customary for piston rings with larger diameters. Therefore, special cast iron alloys having higher strength values must be used for such small piston rings.

According to C. Englisch, Kolbenringe, in translation "Piston Rings", Volume 1, published by Springer Verlag, Vienna, 1958, pages 204 and 245, such cast iron alloys usually comprise up to 1.0% of chromium, molybdenum, vanadium and copper. Such piston rings are cast so as to ledeburitically white harden, and the desired graphite precipitation and the desired structure are obtained by subsequent heat treatment comprising annealing, quenching and tempering. During the annealing treatment there is a graphitization (graphite precipitation) in which tempered carbon is here obtained in spheroidal form, and as a result of this, the strength of the rings is increased substantially. Evidently, however, as a result of the graphite precipitation, the running and wear characteristics of piston rings made of such alloys are insufficient, so that the bearing faces of the rings must be additionally provided with wear protection layers.

According to DE-AS No. 1,172,049, such cast iron alloys are additionally alloyed with 4.5 to 5.5 percent by weight coopper. In such amounts, copper is present in the form of inclusions which take over the part of more compact graphite precipitates. Piston rings cast from these alloys can therefore also be used with wear protection coatings. But these special alloys are suitable only for large piston rings used in Diesel engines and their strength characteristics are insufficient for small piston rings.

According to DE-OS No. 2,428,822, and corresponding British Pat. No. 1,500,766, there is known a cast iron alloy for piston rings in which the normal spheroidal graphite precipitation is realized with special treatment measures. This alloy can contain as alloying element, in addition to 1.5 to 4.5% silicon, up to 1.7% manganese, up to 2.5% vanadium, up to 2.0% molybdenum, up to 2.0% tungsten, up to 0.8% titanium, up to 1.8% copper, up to 0.5% phosphorus, up to 0.8% nickel, and up to 2.0% niobium. The alloy can be produced by inoculation of the melt with ferrosilicon followed by addition by magnesium in elementary or alloyed form. The phosphorus separates out in phosphorus-containing phases. For refining the individual micro structural constituents, the elements antimony, boron, zirconium and bismuth or also the rare-earth metals may be added, but the sum of these elements must altogether be not more than 0.5 percent by weight. The alloys can be heat treated such as, for example, by annealing above 700° C., followed by quenching and subsequent tempering at temperatures which may be between 200° and 700° C. The alloys have a bainitic to martensic matrix structure. The hardness of these alloys lies between HB 250 and HB 500 kg/cm$^2$. These alloys have been found to be sufficiently wear resistant, particularly because of their well balanced composition of the alloying elements. However, the relatively compactly encountered spheroidal graphite again adversely influenced the strength in such a way that these alloys were not sufficiently break-resistant to be used for the manufacture of, in particular, small piston rings having low axial heights.

According to DE-OS No. 2,428,821 and corresponding British Pat. No. 1,482,724, there is known a wear-resistant cast iron alloy suitable for construction of machine parts subject to high frictional stresses which contains 1.5 to 4.0% arbon, 1.5 to 6.0% silicon, less than 0.2% sulfur, less than 2.5% phosphorus, 1.0 to 7.0% copper, a total of 0.4 to 3.2% nickel and cobalt, a total of 0.1 to 1.8% tin and antimony, 0.1 to 4.0% molybdenum, 0.1 to 4% tungsten, 0.05 to 2.5% manganese, 0.3 to 2.5% chromium, 0.3 to 4.0% vanadium, 0 to 2.0% titanium, a total of 0.1 to 4.0% niobium and tantalum, 0.1 to 2.0% aluminum, and the remainder iron. The elements boron, bismuth, zirconium, magnesium and/or the rare earth metals can be added. The cast iron alloys contain uncombined carbon as lamellar and primarily nodular precipitates, and a large number of carbides in a very fine crystalline precipitated form. The cast iron alloys are heat treated by annealing above 700° C., such as for one hour at 850° C., quenching to a temperature of below 500° C., such as at room temperature, and subsequently tempering up to a temperature of 700° C., such as at 350° C. for one hour. The cast iron alloys have a bainitic to martensitic basic structure and a hardness of HV 5 at 550 to 920 Kg/mm$^2$.

SUMMARY OF THE INVENTION

It is therefore an object of the present invention to provide a cast iron alloy having a good wear resistance, as well as good elasticity and high strength, so that it can be used for machine parts which are subject to high stresses.

Another object of the present invention is to provide a cast iron alloy which is primarily intended for use for the manufacture of break resistant small piston rings without special wear protection on their running faces and on their side faces.

Additional objects and advantages of the present invention will be set forth in part in the description which follows and in part will be obvious from the description or can be learned by practice of the invention. The objects and advantages are achieved by means of the compositions, products, processes, instrumentalities and combinations particularly pointed out in the appended claims.

To achieve the foregoing objects and in accordance with its purpose, the present invention provides a wear resistant cast iron alloy of high strength and containing spheroidal graphite precipitates for the manufacture of machine parts subject to wear, comprising a cast iron alloy which has a tempered structure in which the graphite precipitates are formed in a heat treating process in which lederburite decomposes, the graphite being present in an extremely fine form and with a high spheroidal number of approximately 300,000 to 900,000 spheroids per $cm^2$, as measured in a micrograph sample. The cast iron alloy of the present invention has the following composition:

1.5 to 3.0% carbon
3.0 to 6.0% silicon
0.1 to 2.0% manganese
0.05 to 0.5% phosphorus
up to a maximum of 0.15% sulfur
0.1 to 1.0% chromium
0 to 3.5% vanadium
0.1 to 2.5% molybdenum
0.1 to 3.0% total, preferably 0.1 to 2.5% total, of at least one element from the group nickel and cobalt
0.1 to 3.5% copper
0.1 to 2.5% tungsten
0.1 to 1.0% total of at least one element from the group titanium, niobium and tantalum
up to a maximum of 0.15% magnesium
up to a maximum of 0.15% nitrogen, and
remainder iron including impurities inherent in the manufacturing process.

Primarily in order to increase wear resistance, the cast iron alloy can contain addtional ingredients. Thus, the cast iron alloy can additionally contain up to 1.5% aluminum. Further, the cast iron alloy can contain at least one element from the group tin and antimony in a total amount of up to 1.0%. In addition, the cast iron alloy can contain at least one element from the group boron, zirconium and bismuth in a total amount of up to 0.5%.

The present invention also provides a method for producing a cast piece of the above defined cast iron by inoculating a cast iron melt with 0.1 to 1.0% ferrosilicon containing 0.5 to 2.0% magnesium, casting the cast iron melt to harden ledeburitically and form a cast piece, subjecting the cast piece to a graphitization annealing, subsequently quenching to a temperature above 700° C., and then tempering above 300° C. The annealing generally takes place at a temperature above 950° C. The magnesium in the ferrosilicon can be replaced, either completely or in part by one of the rare earth metal elements such as cerium, yttrium, lanthanum, neodymium and praseodymium.

It is to be understood that both the foregoing general description and the following detailed description are exemplary, but are not restrictive of the invention.

BRIEF DESCRIPTION OF THE DRAWINGS

The accompanying drawings illustrate examples of presently preferred embodiments of the invention and, together with the description, serve to explain the principles of the invention.

Of the drawings.

DETAILED DESCRIPTION OF THE PRESENT INVENTION

During manufacture, the method usually employed for the spherical graphite formation is intentionally not used. Instead, the cast iron melt is merely inoculated with commercially available ferrosilicon containing up to 0.5 to 2.0% magnesium. In some cases, the magnesium, is replaced, either completely or in part, by rare earth metals such as cerium, yttrium, lanthanum, neodymium and/or praseodyium. Inoculation takes place with a ferrosilicon inoculation quantity of 0.1 to 1.0% so that the cast iron alloy hardens white and lederburitically. Thereafter, the graphitization annealing process takes place, preferably for 15 minutes above 950° C., quench refining to the desired hardness takes place to a temperature above 700° C., and subseqeuntly tempering above 300° C. The desired hardness is between 95 and 130 HRB (Rockwell-B-Hardness).

Figure 1:
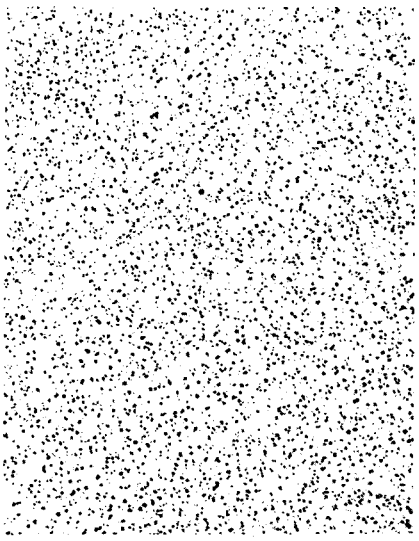
FIG. 1 is a photomicrograph, in a 100 times enlargement, of a cast iron alloy in accordance with the teachings of the present invention.
Figure 2:
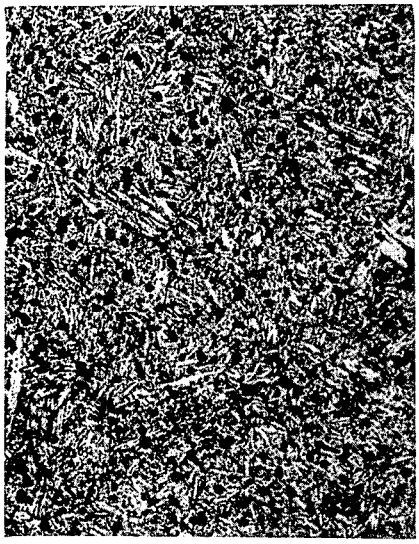
FIG. 2 is a photomicrograph of a cast iron alloy in accordance with the teachings of the present invention and showing the predominantly martensitic structure of the alloy in a 100 times enlargement.

In the micrographs of FIGS. 1 and 2, the structure now appears as a tempered structure with a large proportion of martensite. The graphite is fine grained and spheroidal, and the spheroidal number lies between 300,000 and 900,000 per $cm^2$. When inoculating with low magnesium content ferrosilicon, very fine graphite spheroids already seem to have formed during hardening of the melt; but these are invisible (can not be detected under a light microscope) so that the cast iron appears to be white hardening. In the graphitization annealing process, these fine precipitates serve as germs or nuclei for the spheroids which form in extremely large numbers (and become visible). The spheroid number is thus 5 to 10 tims higher than in normal spherical graphite cast iron alloys. The phosphorus phases are not continuous in the form of a network, but are distributed in the matrix in the form of dots.

Small piston rings were cast from the alloy according to the present invention to outer diameters of about 60 mm, radial wall thickness of 550 mm and axial ring heights of 1.5 mm. These were thermally treated in accordance with the present invention, and worked into ready-for-use piston rings. The rings were subjected to engine test runs without having previously been provided with a wear resistant coating on their bearing faces. They exhibited good wear resistance as well as good strength, and after the run no rings had to be rejected due to ring breakage or wear damage.

The present invention thus provides a cast iron alloy of high wear resistance as well as high breaking strength. The balanced composition of the alloy elements in the alloy provides good slide and running characteristics, although the graphite is present in an extremely fine grained form. The extremely fine distribution of the graphite spheroids itself improves the strength and expansion properties of the workpieces.

Although the alloy according to the present invention can preferably be used for the manufacture of small piston rings having small radial wall thicknesses, it can just as well be used for similarly stressed and/or dimensioned machine parts. These may be sealing strips of rotary piston engines, or extremely thin walled and/or extremely stressed medium size and large piston rings.

The following examples are given by way of illustration to further explain the principles of the invention. These examples are merely illustrative and are not to be understood as limiting the scope and underlying the principles of the invention in any way. All percentages referred to herein are by weight unless otherwise indicated.

EXAMPLE

This example illustrates the manufacture of cast iron piston rings in accordance with the present invention. A cast iron melt is provided, which after being inoculated with 0.6% of a magnesium containing ferrosilicon which contains 47% silicon, 5.9% calcium, 1.1% magnesium, 0.6% aluminum, and remainder iron, had the following composition:

2.68% carbon
4.48% silicon
1.02% manganese
0.31% phosphorus
0.041% sulfur
0.47% chromium
0.25% vanadium
0.47% molybdenum
0.30% nickel
0.41% copper
0.17% titanium
0.11% niobium
0.006% nitrogen
remainder iron with impurities inherent in the manufacturing and inoculating process.

From the melt, 35 small piston ring blanks were cast which had an outer diameter of 55.6 mm, a radial wall thickness of 48.6 mm, and an axial ring height of 5.2 mm and were ledeburitically white hardened. Then the rings were annealed for 15 minutes at 950° C., were quenched and tempered at 450° C. Micrograph 1 shows, in a 100 times enlargement, the graphite precipitates very fine spheroidal form with a spheroidal number of 600,000 per square centimeter. Micrograph 2 shows the tempered structure with predominantly martensitic proportions. The hardness of the rings is at 109 to 115 HRB (Rockwell-B-Hardness).

The rings were then machined to finished dimensions of 52×48×1.5 mm. The average values were:

| | |
|---|---|
| for the modulus of elasticity | 185,200 N/mm$^2$ |
| for bending strength | 1,420 N/mm$^2$ |
| for widening at breakage | 38 mm |

Then 5 rings were tested for 240 hours in a test engine as the uppermost rings of the piston. After the test run, there were neither any broken rings, nor did the bearing faces exhibit greater wear traces.

It will be understood that the above description of the present invention is susceptible to various modifications, changes and adaptations, and the same are intended to be comprehended within the meaning and range of equivalents of the appended claims.

What is claimed is:

1. Wear resistant cast iron alloy of high strength and containing spheroidal graphite precipitates for the manufacture of machine parts subject to wear, comprising a cast iron alloy having the following composition:

1.5 to 3.0% carbon
3.0 to 6.0% silicon
0.1 to 2.0% manganese
0.05 to 0.5% phosphorus
up to 0.15% sulfur
0.1 to 1.0% chromium
0 to 3.5% vanadium
0.1 to 2.5% molybdenum
0.1 to 3.0% total of at least one element from the group nickel and cobalt
0.1 to 3.5% copper
0.1 to 2.5% tungsten
0.1 to 1.0% total of at least one element from the group titanium, niobium and tantalum
up to 0.15% magnesium
up to 0.15% nitrogen,
remainder iron including impurities inherent in the manufacturing process,
said cast iron alloy having a tempered structure in which the graphite is formed by a heat treatment process in which ledeburite decomposes, the graphite being present in an extremely fine form and with a high number of spheroids of about 300,00 to 900,000 per cm$^2$.

2. Cast iron alloy as defined in claim 1, wherein the cast iron alloy additionally contains aluminum in an amount up to a maximum of 1.5%.

3. Cast iron alloy as defined in claim 1, wherein the cast iron alloy additionally contains at least one element from the group tin and antimony in a total quantity of up to a maximum of 1%.

4. Cast iron alloy as defined in claim 2, wherein the cast iron alloy additionally contains at least one element from the group tin and antimony in a total quantity of up to a maximum of 1%.

5. Cast iron alloy as defined in claim 1, wherein the cast iron alloy additionally contains at least one element from the group boron, zirconium and bismuth in a total quantity of a maximum of 0.5%.

6. Cast iron alloy as defined in claim 2, wherein the cast iron alloy additionally contains at least one element from the group boron, zirconium and bismuth in a total quantity of a maximum of 0.5%.

7. Cast iron alloy as defined in claim 3, wherein the cast iron alloy additionally contains at least one element from the group boron, zirconium and bismuth in a total quantity of a maximum of 0.5%.

8. Cast iron alloy as defined in claim 4, wherein the cast iron alloy additionally contains at least one element from the group boron, zirconium and bismuth in a total quantity of a maximum of 0.5%.

9. Method for producing a cast piece of a cast iron alloy of high strength and containing spheroidal graphite precipitates for the manufacture of machine parts subject to wear, the cast iron alloy having the following composition:

1.5 to 3.0% carbon
3.0 to 6.0% silicon
0.1 to 2.0% manganese
0.05 to 0.5% phosphorus
up to 0.15sulfur
0.1 to 1.0% chromium
0 to 3.5% vanadium
0.1 to 2.5% molybdenum
0.1 to 3.0% total of at least one element from the group nickel and cobalt
0.1 to 3.5% copper
0.1 to 2.5% tungsten
0.1 to 1.0% total of at least one element from the group titanium, niobium and tantalum
up to 0.15% magnesium
up to 0.15% nitrogen,
remainder iron including impurities inherent in the manufacturing process,
said cast iron alloy having a tempered structure in which the graphite is formed by a heat treatment process in which ledeburite decomposes, the graphite being present in an extremely fine form and with a high number of spheroids of about 300,00 to 900,000 per $cm^2$, comprising inoculating a cast iron melt with 0.1 to 1.0% ferrosilicon containing 0.5 to 2.0% magnesium, casting the cast iron melt to harden ledeburitically to form a cast piece, and then subjecting the cast piece to a graphitization annealing, subsequently quenching from a temperature above 700° C., and then tempering above 300° C.

10. Method as defined in claim 9, wherein the annealing takes place at a temperature above 950° C.

11. Method for producing a cast piece of cast iron alloy of high strength and containing spheroidal graphite precipitates for the manufacture of machine parts subject to wear, the cast iron alloy having the following composition:

1.5 to 3.0% carbon
3.0 to 6.0% silicon
0.1 to 2.0% manganese
0.05 to 0.5% phosphorus
up to 0.15% sulfur
0.1 to 1.0% chromium
0 to 3.5% vanadium
0.1 to 2.5% molybdenum
0.1 to 3.0% total of at least one element from the group nickel and cobalt
0.1 to 3.5% copper
0.1 to 2.5% tungsten
0.1 to 1.0% total of at least one element from the group titanium, niobium and tantalum
up to 0.15% magnesium
up to 0.15% nitrogen,
remainder iron including impurities inherent in the manufacturing process, said cast iron alloy having a tempered structure in which the graphite is formed by a heat treatment process in which ledeburite decomposes, the graphite being present in an extremely fine form and with a high number of spheroids of about 300,00 to 900,000 per $cm^2$, comprising inoculating a cast iron melt with 0.1 to 1.0% ferrosilicon containing 0.5 to 2.0% magnesium or at least one of the rare earth metals of cerium, yttrium, lanthanum, neodymium and praseodymium, or a mixture of magnesium and at least one of said rare earth metals, the total amount of magnesium and the rare earth metals in the ferrosilicon being 0.5 to 2.0%, casting the cast iron melt to harden ledeburitically to form a cast piece, and then subjecting the cast piece to a graphitization annealing, subsequently quenching from a temperature above 700° C., and then tempering above 300° C.

12. Method as defined in claim 11, wherein the annealing takes place at a temperature above 950° C.

13. Method as defined in claim 11, wherein the ferrosilicon contains magnesium.

14. Method as defined in claim 11, wherein the ferrosilicon contains 0.5 to 2.0% of said rare earth metal.

15. A cast body which has a uniform structure which is distributed over the entire cast body, the cast body being made from the cast iron alloy of claim 1.

16. The cast body according to claim 15, wherein the cast body is a piston ring for an internal combustion engine.

17. The cast body according to claim 16, wherein the piston ring is a small piston ring.

18. The cast body according to claim 17, wherein the small piston ring has a low axial wall thickness.

19. The cast body according to claim 17, wherein the small piston ring has a small radial wall thickness.

* * * * *